US007624901B1

(12) United States Patent
Mozes

(10) Patent No.: US 7,624,901 B1
(45) Date of Patent: Dec. 1, 2009

(54) NOISE-FREE RETAINER FOR HAND-HELD ELECTRONICS

(76) Inventor: Raymond P Mozes, 1513 Methodist Rd., Greenville, PA (US) 16125

( * ) Notice: Subject to any disclaimer, the term of this patent is extended or adjusted under 35 U.S.C. 154(b) by 280 days.

(21) Appl. No.: 11/633,931

(22) Filed: Dec. 5, 2006

(51) Int. Cl.
*B65D 25/52* (2006.01)
*B65D 85/38* (2006.01)

(52) U.S. Cl. ..... 224/197; 206/37; 206/305; 224/666; 224/930

(58) Field of Classification Search ..... 206/305, 206/320, 37–39; 224/197, 666–669, 904, 224/908, 929, 930, 269; 361/683, 686
See application file for complete search history.

(56) References Cited

U.S. PATENT DOCUMENTS 4,419,794 A * 12/1983 Horton et al. ..... 224/197
4,828,153 A * 5/1989 Guzik et al. ..... 224/269
5,829,651 A * 11/1998 Luchka ..... 224/267
6,029,871 A * 2/2000 Park ..... 224/197
6,578,745 B1 * 6/2003 Taylor et al. ..... 224/197
6,722,539 B2 * 4/2004 Iitsuka ..... 224/197
6,955,279 B1 * 10/2005 Mudd et al. ..... 224/197
6,955,280 B2 * 10/2005 Saitoh et al. ..... 224/930
2002/0139822 A1 * 10/2002 Infanti ..... 224/197
2003/0106917 A1 * 6/2003 Shetler et al. ..... 224/197
2004/0200867 A1 * 10/2004 Chee ..... 224/197
2007/0215663 A1 * 9/2007 Chongson et al. ..... 224/930

* cited by examiner

*Primary Examiner*—Luan K Bui
(74) *Attorney, Agent, or Firm*—Richard K Thomson

(57) ABSTRACT

A retainer for securing a hand-held electronic or optical device is made of a soft, pliable elastomeric material so that inserting and removing the device is accomplished without significant sound so as not to startle wildlife which may be in the vicinity. The retainer has a pair of flexible retention fingers on either side of a slot that receives a retention post affixed to the hand-held device to secure it in the retainer. The retainer has a toothed grip clip which can swivel between a teeth up and a teeth down position and has a toggle mechanism which ensures engagement of the teeth with an article of the user's clothing.

5 Claims, 7 Drawing Sheets

NOISE-FREE RETAINER FOR HAND-HELD ELECTRONICS

BACKGROUND AND SUMMARY OF THE INVENTION

The present invention is directed to the field of electronics. More particularly, the present invention is directed to a retainer for hand-held electronic devices which is essentially noise free.

Increasing numbers of electronic devices are available to enhance the enjoyment of outdoor enthusiasts of the wonders nature has to offer. For the purposes of this specification, the term "electrical devices" is defined as including optical devices, as well. These devices include hand-held GPS units, cameras, laser range finders, and pocket radios. Typically, having these items stored in pockets is unacceptable since they are relatively inaccessible. Accordingly, people have attempted to adapt cell phone cases or attachment devices to suspend these items on their person. These jury-rigged systems are largely unsatisfactory for a number of reasons.

One of the main reasons is that these attachment devices are made of a hard plastic. Outdoor enthusiasts, be they hunters, photographers or bird watchers, need to move with the utmost stealth/silence in order to avoid startling the animals they are wishing to find. Hard plastic attachment devices create clattering as the hand-held electronic device is removed for use and returned to its stored location. When walking in the woods, the slightest sound is seemingly amplified and, for the acute hearing of wildlife creatures, becomes the warning which startles them to flight.

A second reason these cobbled together systems are inadequate is that both the means to secure the hand-held device to the attachment device and the means to secure the attachment device to the user's clothing are generally suspect and their usage may result in loss of a costly piece of electronic equipment. It is the object of the present invention to overcome the deficiencies with the available prior art hand-held electronic attachment devices.

The present invention comprises a noise-free retainer for a hand-held electronic device having a retention post, the noise-free retainer comprising a body portion having a retention-post-receiving slot, the body portion being made of a soft, pliable material for noise-free engagement with the retention post of the hand-held electronic device; grip clip means attached to the body portion, the grip clip means employing a toggle lock to secure the noise-free retainer to an article of clothing. A circular recess is formed at a bottom of the retention-post-receiving slot, a necked down region transitioning between the retention-post-receiving slot and the circular recess which defines two retention fingers which flex to receive and release the retention post of the hand-held electronic device.

Preferably, the soft, pliable material from which the body portion is made is selected from the group consisting of vulcanized rubber, flexible polyurethane, thermoplastic elastomer and other man-made rubber-like materials. An optional feature includes a lanyard having a first end attached to an upper end of the body portion and a second end attachable to the hand-held electronic device. Preferably, the lanyard is made of an elastic cord which can stretch from a length of 12" up to 3' to permit utilization of the hand-held electronic device without detaching it. The noise-free retainer includes a pivot post securing the grip clip means to the body portion whereby the grip clip means may be pivoted between two rotational position relative to the body to engage an article of clothing from above or below while maintaining the hand-held electronic device in a desired orientation.

The grip clip means comprises a first toothed C-shaped member, a second toothed L-shaped member pivotally mounted to the first C-shaped member, means biasing the first and second toothed L-shaped members to an open position, and a toggle latch overlying the second toothed L-shaped member, the toggle latch being rotated between a first position allowing the biasing means to open the first and second L-shaped members and a second position maintaining the first and second L-shaped members in a closed position.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 4B:
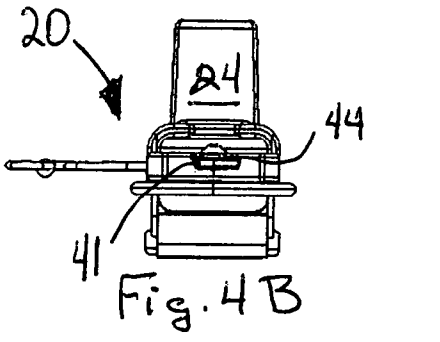
FIG. 4B is a top view of the first embodiment.
Figure 4A:
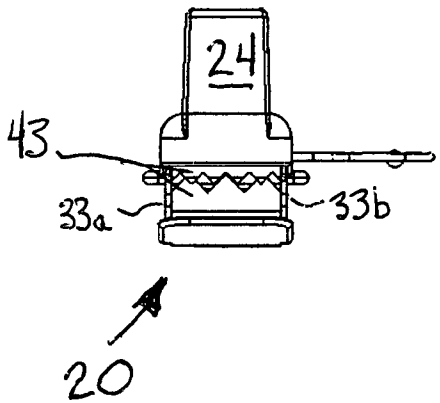
FIG. 4A is a bottom view of the first embodiment.
Figure 1:
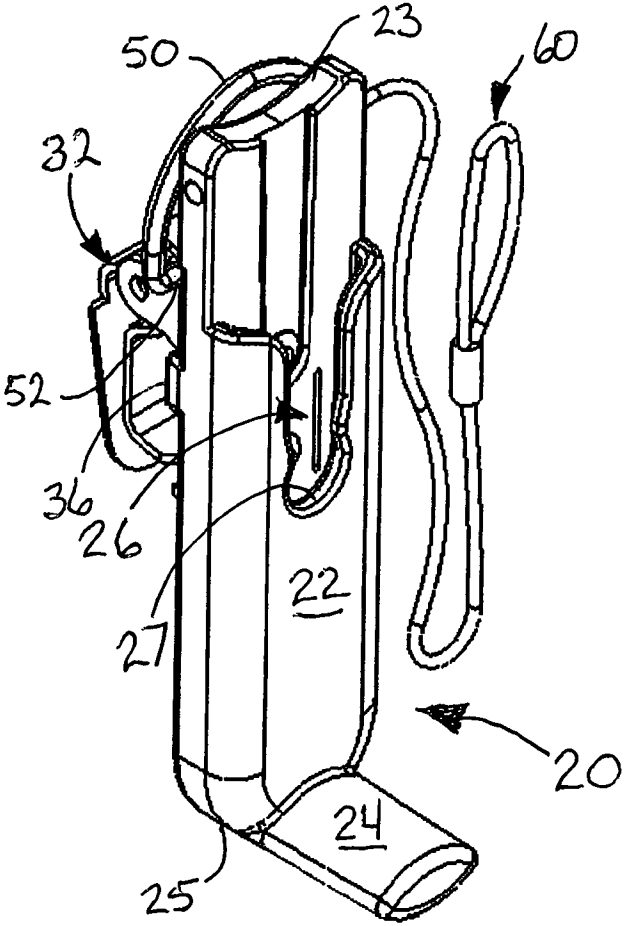
FIG. 1 is a perspective front view of a first embodiment of the noise-free retainer of the present invention.
Figure 3:
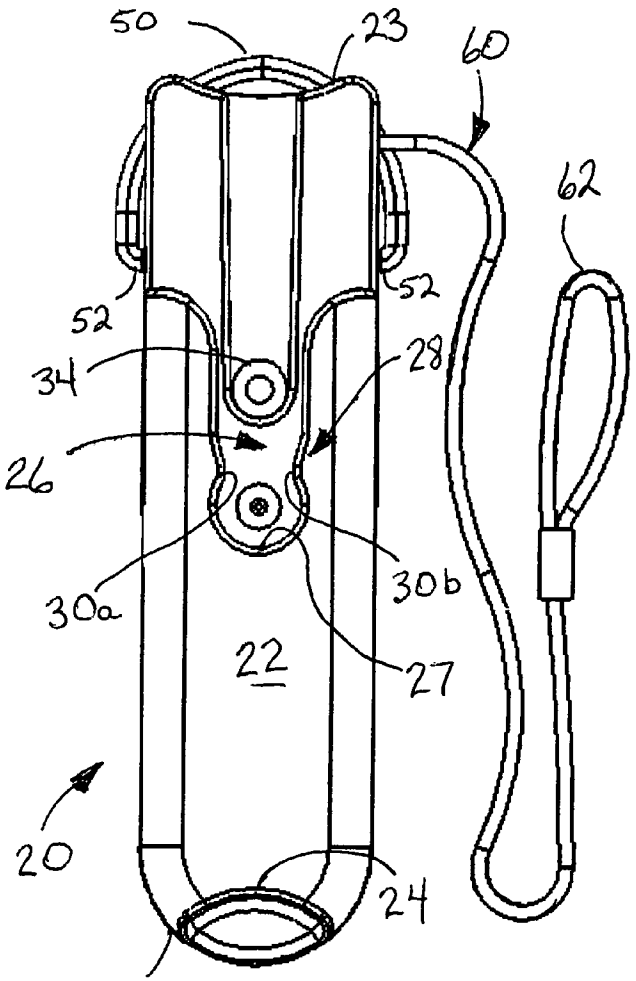
FIG. 3 is a front view of the first embodiment.
Figure 2:
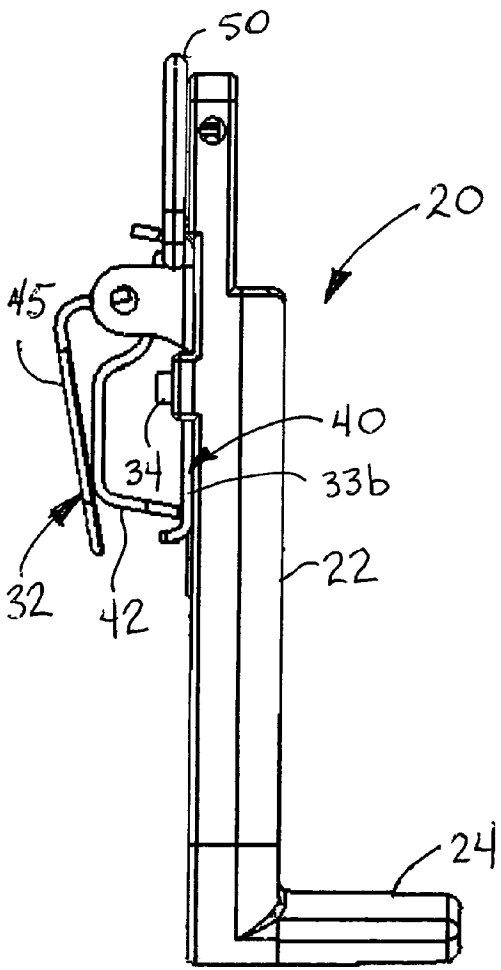
FIG. 2 is a side view of the first embodiment.

A first embodiment of the noise-free retainer for hand-held electronics is shown in FIGS. 1-4A generally at 20. Retainer 20 comprises an elongated body portion 22 with a first end 23 and a second end 25 and having an extending support foot 24 extending from one face of second end 25, foot 24 underlying certain hand-held electronic devices. Obviously, the length of foot 24 can be varied to accommodate different pieces of equipment and, in some cases, eliminated all together. Body portion 22 is made from a soft, pliable material which provides the noise-free engagement between the body portion and the hand-held electronic device. This material is preferably selected from a group consisting of vulcanized rubber, flexible polyurethane, thermoplastic elastomer and other man-made rubber-like materials.

Body portion 22 has a retention-post-receiving slot 26 for receiving a retention post from any of a variety of hand-held electronic devices. Retention-post-receiving slot 26 terminates in a circular recess 27. While a number of electronic devices are equipped with such retention posts, the present invention includes a retention post mounting plate 11 (FIG. 4C) which can affixed to a flat side of the electronic device 15 using a double-sided adhesive. Plate 11 includes a retention post 13 having an enlarged head portion 14. By way of example, the tape of choice is a foamed acrylic very high bond (VHB) adhesive tape available from 3M Corp. Slot 26 has a necked-down transition region 28 which define two retention fingers 30*a* and 30*b* which flex inwardly to receive and release the retention post 13.

Grip clip means 32 is rotationally attached to body portion 22 by post 34. Grip clip means 32 includes a first C-shaped toothed member 40 and a second L-shaped toothed member 42 pivotally mounted to first member 40. A D-ring 50 has a pair of arms 52 which fit between first C-shaped member and second L-shaped member 42. Tang 44 on the back of second L-shaped member 42 fits in a slot 41 on the upper arm of C-shaped member 40. The position of tang 44 in slot 41 and the arms 52 between first C-shaped member 40 and second L-shaped member 42 creates a fulcrum that forms a biasing means which urge first and second toothed members 40, 42 to an open position. A toggle latch 45 overlies second L-shaped toothed member 42 and rotates between a first position allowing the biasing means to open first C-shaped and second L-shaped members 40, 42 and a second position maintaining first C-shaped and second L-shaped members 40, 42 in a closed position. Two lateral fingers 36 extend from a mid section of body portion 22 engaging sides 33*a* and 33*b* of grip clip means 32 securing it in either of two positions aligned with body portion 22 so the teeth 43 can engage an item of clothing or other material from the bottom or top, as desired by the user.

Noise-free retainer 20 allows retention post 13 (or a retention post associated with the hand-held electronic device 15) to be inserted into slot 26 by exerting axial downward pressure. Retention fingers 30*a* and 30*b* flex outwardly to permit post 13 to pass into circular recess 27 and inwardly to retain post 13 in the recess 27. Because housing 22 is made of soft, pliable material, insertion and removal of the electronic device 15 results in post 13 making significantly less noise than it otherwise would if housing 22 were made of a rigid plastic, for example. Axial upward pressure on post 13 causes retention fingers 30*a* and 30*b* to flex outwardly releasing from retainer 20 so that the electronic device 15 may be utilized. An optional feature is lanyard 60 which can be attached first end 23 of body portion 22. The distal end 62 has a loop which can be attached to post for that purpose which is provided on the hand-held device 15. Some devices are provided with their own lanyards which can be attached to D-ring 50. The use of lanyard 60 ensures that hand-held device 15 will not be inadvertently dropped should retention post 13 not be properly returned to slot 26.

Figure 6B:
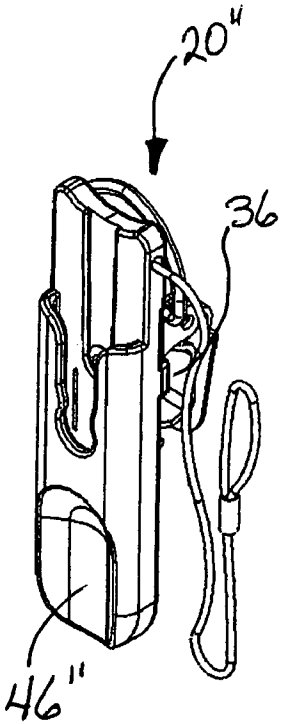
FIG. 6B is a front perspective view of the second embodiment.
Figure 6A:
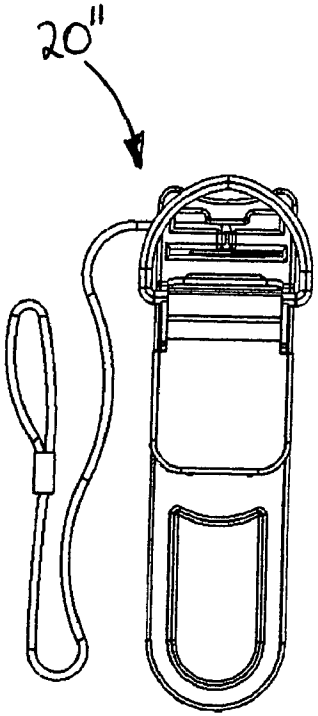
FIG. 6A is a rear view of the second embodiment.
Figure 4C:
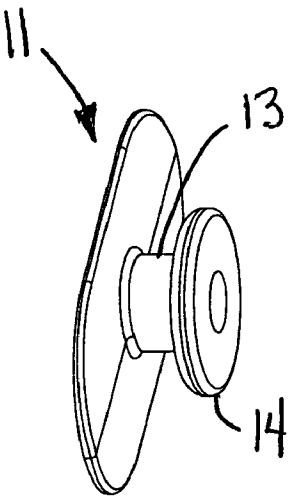
FIG. 4C is a perspective view of a retention post mounting plate which can be attached to any hand-held electronic device.
Figure 5:
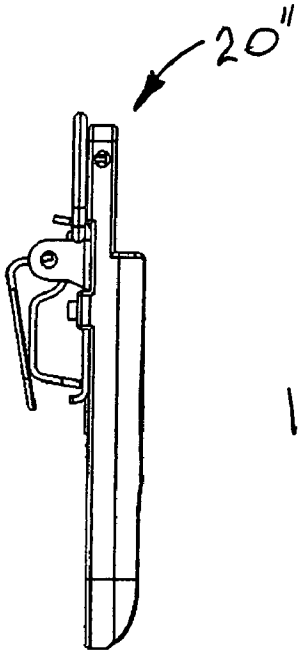
FIG. 5 is a side view of a second embodiment.
Figure 10:
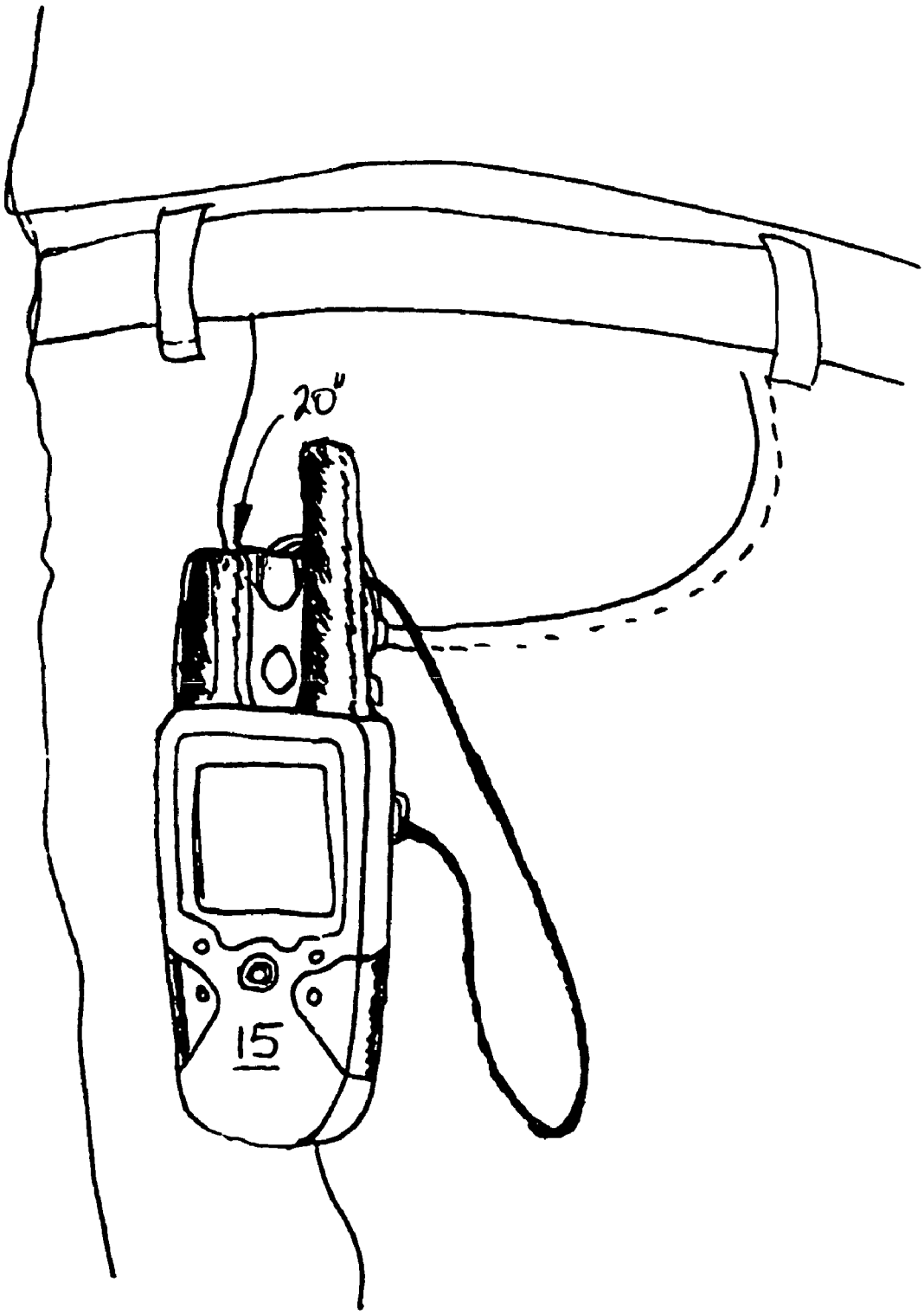

FIGS. 5, 6A and 6B depict a second embodiment of the present invention generally at 20". Retainer 20" has been specifically reconfigured to receive a GPS having a hemispherical protrusion on its lower rear portion. Recess 46" is specifically configured on the front of retainer 20" to receive the protrusion enhancing the securement thereof (see FIG. 10). This reconfiguration is merely exemplary of the type of changes which can be made to accommodate hand-held electronic devices 15 having particular features.

Figure 7:
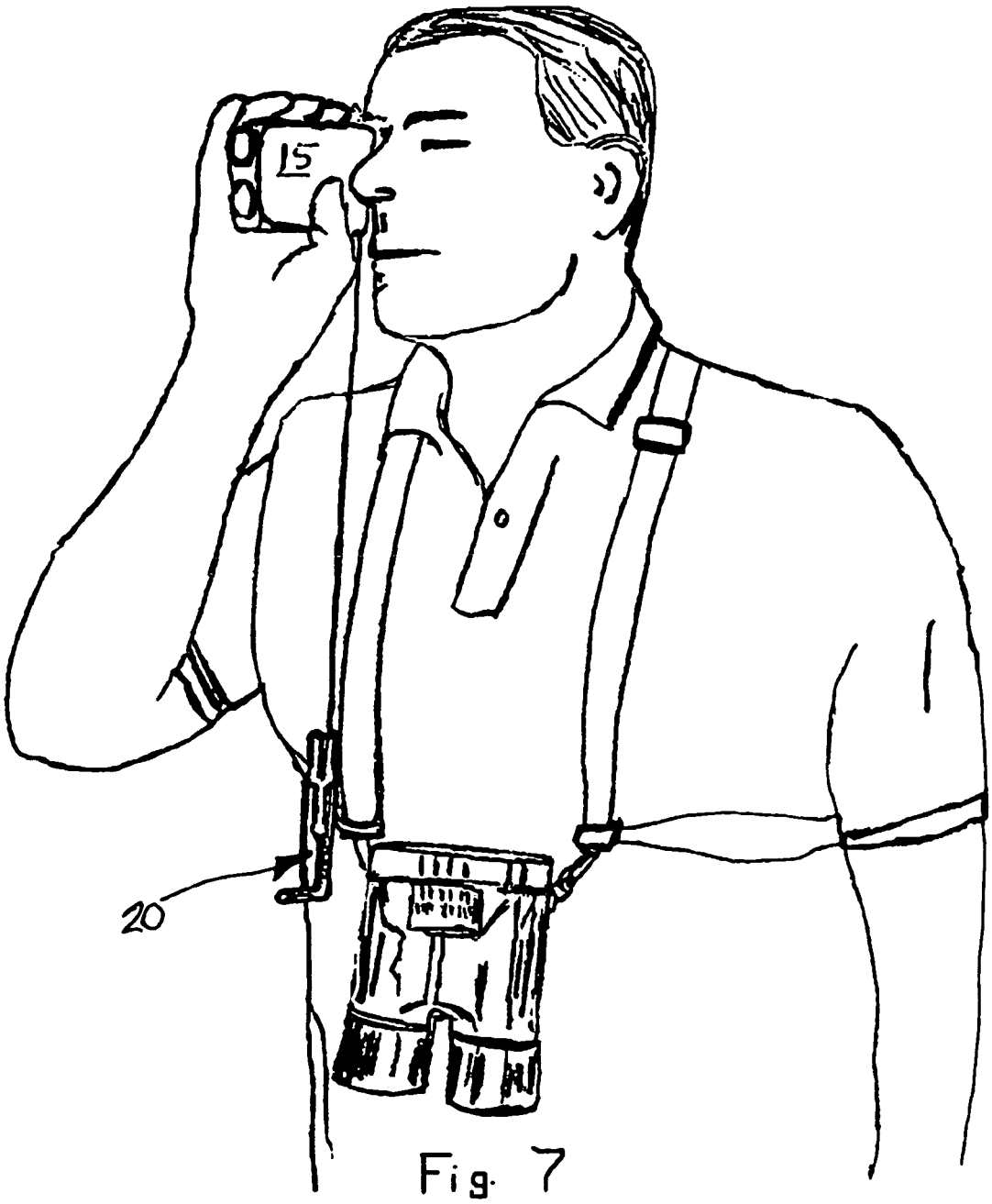
FIG. 7 is a schematic depiction of the first embodiment employing the optional lanyard utilized with a range finder.
Figure 8:
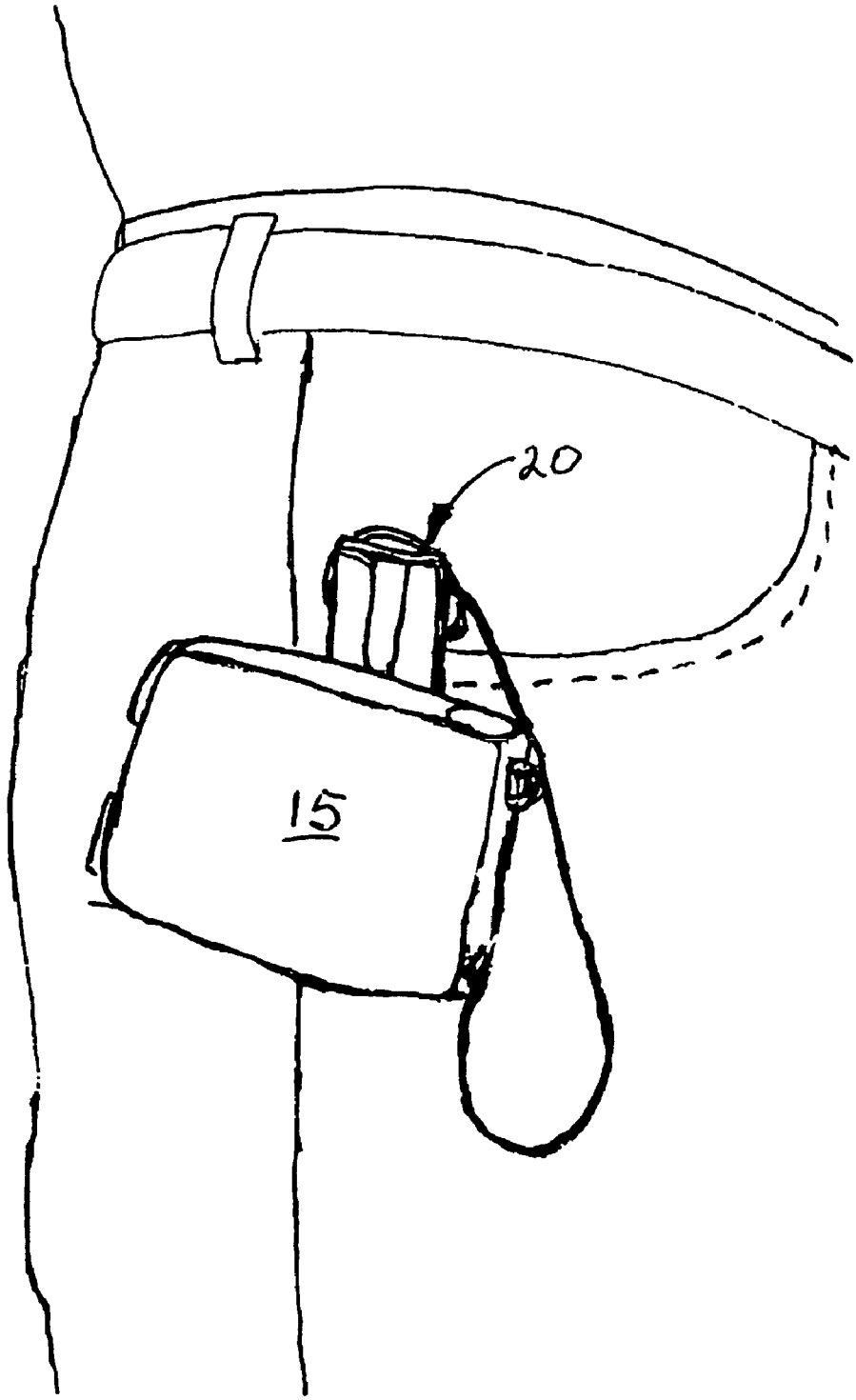
FIG. 8 is a schematic depiction of the first embodiment also used with a range finder showing an alternative clip location.

FIGS. 7 and 8 depict the first embodiment of the noise-free retainer 20 utilized with a laser range finder 15. FIG. 7 depicts retainer being utilized with an optional elastomeric lanyard 60 which can stretch from an untensioned length of 12" to a stretched length of 3'. In FIG. 7, retainer 20 is attached to a horizontally extending portion of suspenders 17. FIG. 8 depicts retainer clipped to the top of a pants pocket 19.

Figure 9:
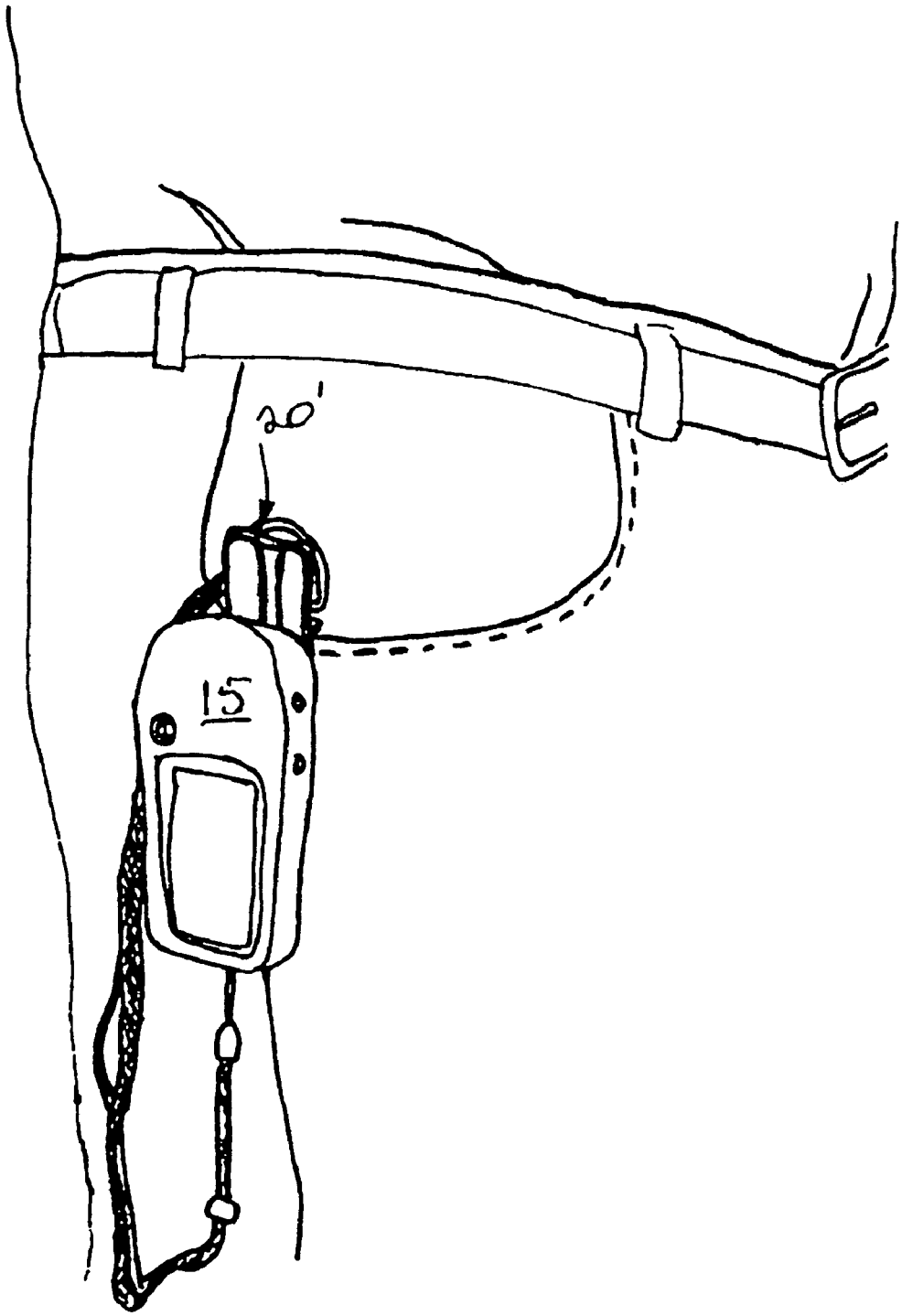
FIG. 9 is a schematic depiction of a modified first embodiment used with a first style of GPS; and, FIG. 10 is a schematic depiction of the second embodiment utilized with a second style of GPS unit.

FIG. 9 depicts a modified version of the first embodiment of the noise-free retainer 20' is used to secure a GPS unit to a pants pocket. It has been earlier suggested that the length of support foot 24 can be shortened for use with thinner devices and such is the case in the utilization depicted in FIG. 9.

The noise-free retainer 20 for hand-held electrical devices of the present invention enhances the outdoor experience for the user by allowing the electronic/optical device with which it is used to be removed without creating clattering noises which can startle wildlife being sought for viewing or skewering.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A retainer for a hand-held electronic device having a retention post, said retainer comprising:

a) a body portion having a retention-post-receiving slot, said body portion being made of a soft, pliable material for engagement with the retention post of the hand-held electronic device quietly, said body portion being made of a material selected from the group consisting of vulcanized rubber, flexible polyurethane, thermoplastic elastomer and other man-made rubber-like materials, said body portion including a circular recess at a bottom of said retention-post-receiving slot, a necked down region transitioning between said retention-post-receiving slot and said circular recess which defines two retention fingers which flex to receive and release the retention post of the hand-held electronic device;

b) grip clip means attached to said body portion, said grip clip means employing a toggle lock to secure said retainer to an article of clothing and including a first toothed C-shaped member, a second toothed L-shaped member pivoted to said first C-shaped member, biasing means urging said first toothed C-shaped member and said second toothed L-shaped member to an open position, and a toggle latch overlying said second toothed L-shaped member, each of said first and said second toothed members having saw teeth extending laterally across its clothing-engaging face, said toggle latch being rotated between a first position allowing said biasing means to open said first toothed C-shaped and second toothed L-shaped members and a second position maintaining said first toothed C-shaped and second toothed L-shaped members in a closed position;

d) a pivot post securing said grip clip means to said body portion whereby said grip clip means may be pivoted between two rotational positions relative to said body to engage an article of clothing from above or below while maintaining the hand-held electronic device in a desired orientation.

2. The retainer of claim 1 further comprising an extending support foot protruding from one end of said body portion.

3. The retainer of claim 1 further comprising a lanyard having a first end attached to an upper end of said body portion and a second end attachable to the hand-held electronic device.

4. The retainer of claim 3 wherein said lanyard is made of an elastic cord which can stretch from a length of 12" up to 3' to permit utilization of the hand-held electronic device.

5. The retainer of claim 1 further comprising a D-ring having pivot arms which extend between said first C-shaped and said second L-shaped members, said pivot arms forming a portion of said biasing means.

* * * * *